US006202850B1

(12) United States Patent
Held

(10) Patent No.: US 6,202,850 B1
(45) Date of Patent: Mar. 20, 2001

(54) GOLF BAG COVER AND METHOD OF USE

(75) Inventor: William T. Held, Elma, NY (US)

(73) Assignee: Mini Club Protector, Inc., Elma, NY (US)

( * ) Notice: Subject to any disclaimer, the term of this patent is extended or adjusted under 35 U.S.C. 154(b) by 0 days.

(21) Appl. No.: 09/428,976

(22) Filed: Oct. 28, 1999

Related U.S. Application Data

(60) Provisional application No. 60/117,414, filed on Jan. 27, 1999.

(51) Int. Cl.[7] ..... A63B 55/00; A63B 57/00

(52) U.S. Cl. ..... 206/527; 206/315.4; 150/159

(58) Field of Search ..... 206/315.3, 315.4, 206/527; 150/159

(56) References Cited

U.S. PATENT DOCUMENTS

| | | | | |
|---|---|---|---|---|
| 8,222 | | 7/1851 | Hibbard . | |
| 208,564 | | 10/1878 | Bowers . | |
| 2,509,195 | * | 5/1950 | Barron | 206/315.4 |
| 2,907,364 | * | 10/1959 | Trenery | 206/315.4 X |
| 3,059,681 | * | 10/1962 | Lorbeski | 206/315.4 X |
| 3,460,597 | * | 8/1969 | Day | 206/315.4 |
| 3,913,648 | | 10/1975 | Sessler | 206/315.4 |
| 4,200,133 | | 4/1980 | Whitlow | 150/159 |
| 4,442,937 | | 4/1984 | Delauder | 206/315 |
| 4,453,632 | * | 6/1984 | Clower | 206/315.4 |
| 4,699,164 | | 10/1987 | Pilney et al. | 135/16 |
| 4,788,996 | * | 12/1988 | Forshee | 206/315.4 X |
| 4,979,548 | | 12/1990 | Howard, III et al. | 150/159 |
| 5,005,623 | | 4/1991 | Webster, Jr. | 150/159 |
| 5,024,259 | | 6/1991 | Treadway | 150/159 |
| 5,050,730 | | 9/1991 | Suberbielle | 206/315.4 |
| 5,058,642 | | 10/1991 | Tuntland | 150/159 |
| 5,131,442 | | 7/1992 | Bevier | 150/159 |
| 5,819,829 | * | 10/1998 | Matthews | 206/315.4 X |

FOREIGN PATENT DOCUMENTS

| | | | | |
|---|---|---|---|---|
| 2452 | * | 9/1911 | (GB) | 206/315.3 |
| 2103938 | * | 3/1983 | (GB) | 206/325.4 |

* cited by examiner

*Primary Examiner*—Sue A. Weaver
(74) *Attorney, Agent, or Firm*—Hodgson Russ Andrews Woods & Goodyear LLP

(57) ABSTRACT

The present invention relates to a golf bag cover device which is mounted over and about a rim surrounding the opening leading into a golf bag to protect the clubs from inclement weather and the like. The cover device comprises three ribs connected to a base mounted about to the rim. The ribs support a canvas or plastic cover. One of the ribs extends in a generally horizontal orientation beyond the perimeter of the rim. That way, a golfer can reach up and into the open end, causing the one rib to pivot toward a second rib which in turn pivots toward a third rib to provide access to the clubs. This construction enables a golfer to grab a club without having to touch the palm of his hand to the cover, thereby providing a dry and secure grip on the club.

7 Claims, 6 Drawing Sheets

GOLF BAG COVER AND METHOD OF USE

CROSS-REFERENCE TO RELATED APPLICATION

The present application claims priority based on provisional application Ser. No. 60/117,414, filed Jan. 27, 1999.

BACKGROUND OF THE INVENTION

1. Field of the Invention

The present invention relates to a device for use in playing the game of golf, and more particularly, a cover device mounted on and about the open end of a golf bag to protect the clubs from inclement weather and the like.

2. Prior Art

The prior art describes various devices for mounting on a golf bag to protect the clubs stored in the bag. However, for a cover device to be useful to a golfer, the cover must protect the clubs regardless of the weather while enabling the golfer to readily access the clubs many times during a game. The cover must be easy to mount on and remove from the golf bag, and must provide ready access to the clubs for making a shot and then allow the golfer to replace the club back in the bag.

Representative golf bag covers that serve this purpose are described in U.S. Pat. No. 3,913,648 to Sessler, U.S. Pat. No. 5,024,259 to Treadway and U.S. Pat. No. 5,058,642 to Tuntland, which show various flexible covers that are secured about the opening leading into a golf bag to protect the clubs. The flexible covers have an open flap portion which is not secured to the golf bag and provides for access to the clubs. U.S. Pat. No. 4,200,133 to Whitlow, U.S. Pat. No. 4,699,164 to Pilney et al., U.S. Pat. No. 4,979,548 to Howard, III et al. and U.S. Pat. No. 5,005,623 to Webster, Jr. all relate to golf bag covers having a tubular sleeve secured to the perimeter of the open end of a golf bag. The sleeve is allowed to drape over the side of the golf bag with the opposite open end providing access to the clubs. U.S. Pat. No. 5,131,442 to Bevier relates to a golf bag cover of flexible material having a flap edge spaced from the open end of the golf bag. In use, the edge is raised to remove a club from the bag. U.S. Pat. No. 4,442,937 to Delauder and U.S. Pat. No. 5,050,730 to Suberbielle relate to rigid golf bag covers pivotally secured to the golf bag. The covers are pivoted from a closed position into an open position to access the clubs.

The drawback with the various prior art golf bag covers is that none of them enable a golfer to reach into the golf bag without touching the palm of his hand to the cover device. During rainy weather this can cause a golfer to get water on his hand which is detrimental to a firm grip on the golf club. In that respect, the present cover device is an improvement over the prior art. With the present cover device, the golfer reaches under an open edge of the cover, up and into the bag to grab a club without touching the cover device with the palm of the golf glove. This prevents the palm of the golf glove from getting wet during inclement weather. A cover that does not provide access to the clubs without getting the golfer's palm wet defeats the purpose of the cover to begin with, which is to keep club grips dry. A dry palm gripping a dry club grip insures that the club will not slip in the golfer's hand during a shot.

SUMMARY OF THE INVENTION

The present invention relates to a golf bag cover device which is secured over and about the upper opening leading into a golf bag. The cover device comprises three ribs that support a canvas or plastic cover. One of the ribs is pivotably connected to a base mounted on a rim of the bag surrounding the upper opening and extends beyond the perimeter of the upper opening. To access the clubs, the golfer reaches under this rib, which pivots upwardly as the golfer continues to extend his hand into the bag to grab a club. As the golfer reaches into the bag, only the back of his hand contacts the pivoting rib which moves up toward a second rib that in turn pivots up toward a stationary third rib. The golfer is now able to easily grab a club and remove the club from the golf bag to make a shot. When it is raining, the present golf bag cover device enables the golfer to reach and select a golf club without getting the palm of his hand wet.

These and other aspects of the present invention will become more apparent to those skilled in the art by reference to the following description and to the appended drawings.

DETAILED DESCRIPTION OF THE PREFERRED EMBODIMENTS

Figure 1:
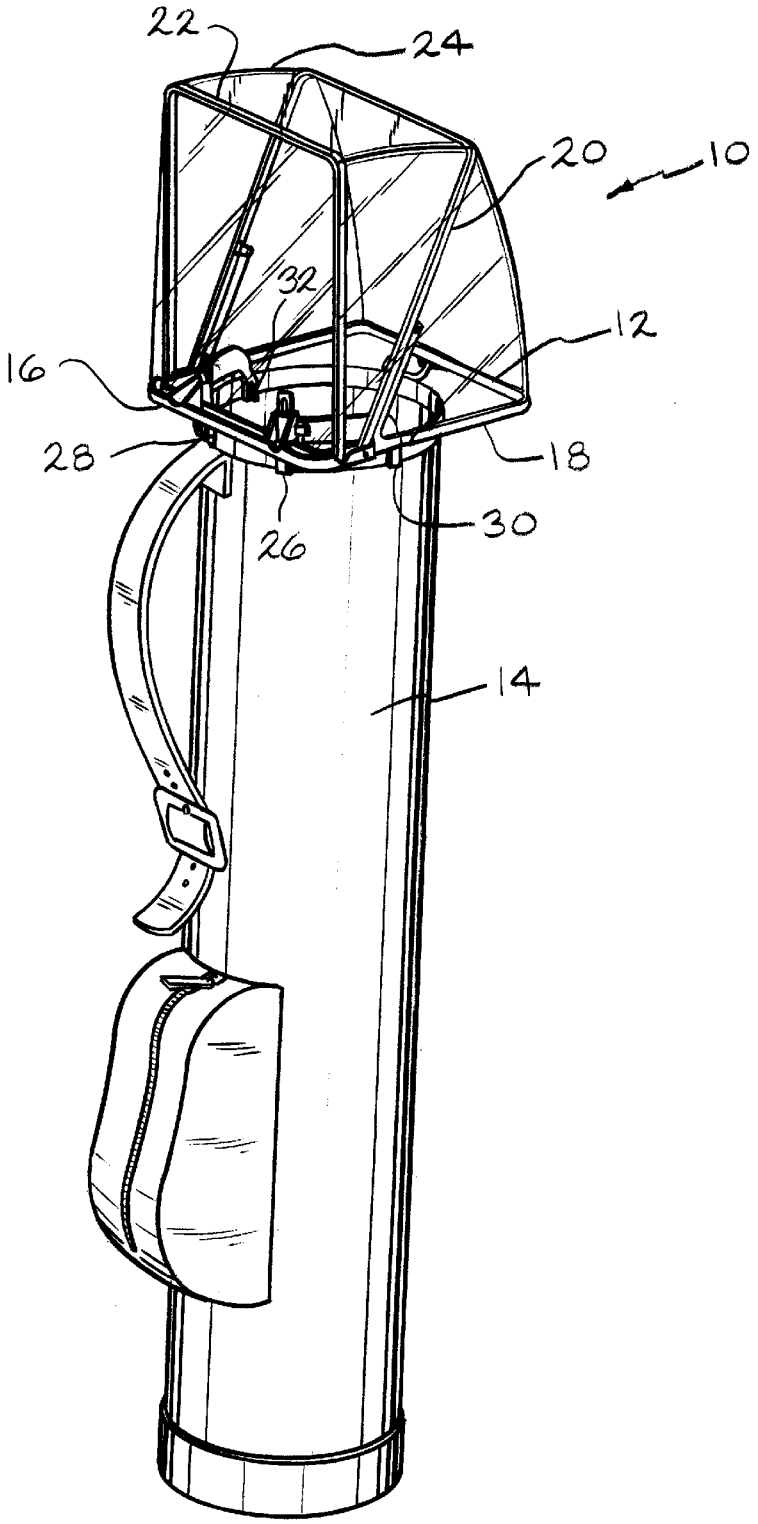
FIG. 1 is a perspective view of a golf bag cover device according to the present invention mounted on a golf bag.
Figure 2:
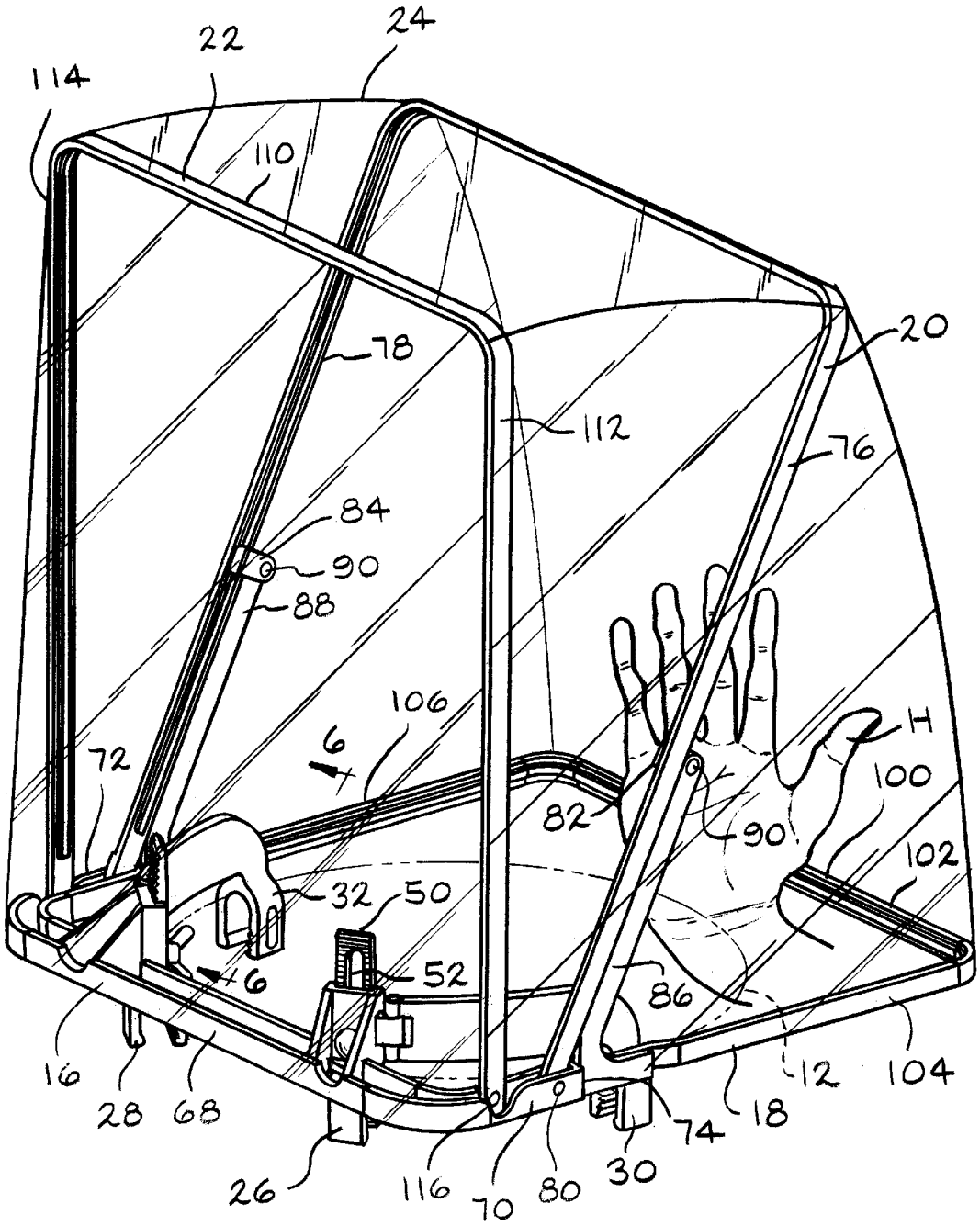
FIG. 2 is an enlarged perspective view of the golf bag cover device shown in FIG. 1.

Turning now to the drawings, FIGS. 1 and 2 show a golf bag cover device 10 according to the present invention secured to a rim 12 surrounding the open end of a golf bag 14. The golf bag cover device 10 includes a base member 16 and two pivotably mounted ribs 18 and 20 and a third stationary rib 22. The ribs 18, 20 and 22 are mounted to the base 16 and support a cover 24 of a thermoplastic or cloth material such as water-repellent canvas. The cover device 10 further includes a pair of forward clips 26 and 28 mounted to the base 16 and adjustable in a vertical direction, and a pair of rearward clips 30 and 32 pivotably mounted to respective ones of the forward clips. The forward pair of clips and the rearward pair of clips provide for removably securing the cover device 10 to the rim 12 (shown in dashed lines in FIG. 2) surrounding the opening leading into the golf bag 14. As particularly shown in FIG. 3 to 5 with respect to forward clip 26, each of the forward mounting clips 26 and 28 and the rearward mounting clips 30 and 32 has a downwardly facing U-shaped portion 34 having an inwardly facing protuberance 36 at the lower end of an outer leg 38 thereof and an inner gripping surface 40 for firmly securing the cover device 10 to the rim 12 of the golf bag.

Figure 6:
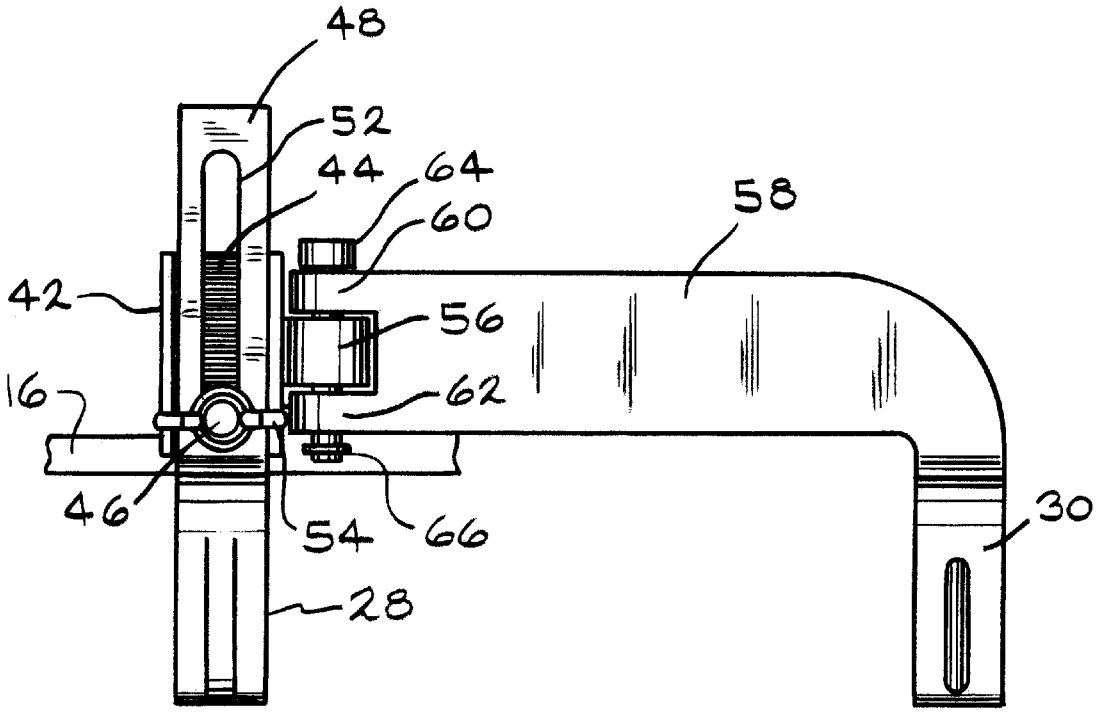
FIG. 6 is a cross-section taken along line 6—6 of FIG. 2.

For the sake of clarity, the vertically adjustable structure of the forward clips 26 and 28 will be described with respect to clip 28 (FIG. 6). Clip 28 includes a tower 42 extending vertically upwardly from the base 16. The vertical tower 42 has a serrated surface 44 and an opening (not shown) for receiving a bolt 46. The clip 28 has an extension portion 48 extending upwardly from the trough of the downwardly facing U-shaped portion 34. The extension portion 48 has a serrated surface 50 (FIG. 2) that mates with the serrated surface 44 of the vertical tower 42 and an oval-shaped slot 52 extending the majority of the length of the extension portion 48. A wing nut 54 threads onto the bolt 46 extending through the opening with vertical tower 42 and the slot 52 to mate the serrated surfaces 44 and 50. The vertical height of the clip 28 is adjusted by loosening the nut 54 from the bolt 46 and moving the slot 52 of the extension portion 48 along the shaft of the bolt 46. When the clip 28 is at the proper vertical elevation, the nut 54 is tightened on the bolt 46 to mate the serrated surfaces 44 and 50 in a non-slip engagement. The vertical adjustment of clip 26 is identical to clip 28.

As shown in FIG. 6, the vertical tower 42 further supports a cylindrically-shaped member 56 having a through bore (not shown). The rearward clip 30 is provided with an arm 58 having a pair of spaced apart fingers 60 and 62 with respective bores extending therethrough. The fingers 60 and 62 are vertically spaced apart a distance sufficient to receive the cylindrical member 56 with the respective through bores aligned to receive a pivot pin 64 secured in place by a snap clip 66. The pivot pin 64 provides for pivoting movement of the rearward clip 30 with respect to the forward clip 28. The pivotable structure of the rearward clip 32 with respect to its associated forward clip 28 is identical. Thus, the pair of forward clips 26 and 28 are vertically adjustable and their associated rearward clips 30 and 32 are pivotably adjustable to provide for mounting the cover device 10 on golf bags having rims 12 of various sizes.

The base member 16 has a channel shape in cross-section (FIG. 2) and includes a forward portion 68 extending to and meeting with spaced apart rearwardly extending legs 70 and 72 to provide the base having a U-shape in plan view. The channel is closed at the end of each of the rearwardly extending legs 70 and 72 by respective end walls 74 (only one shown in the figures).

The second rib 20 is a U-shaped member having the ends of each of its legs 76 and 78 received inside the respective legs 70 and 72 of the base 16 and pivotably connected thereto by pivot pins 80 (only one shown). The pivotable connection is located so that the second leg 76 and 78 rests against the end walls 74 with rib 20 in a forwardly most position, as shown in FIG. 2.

Figure 3:
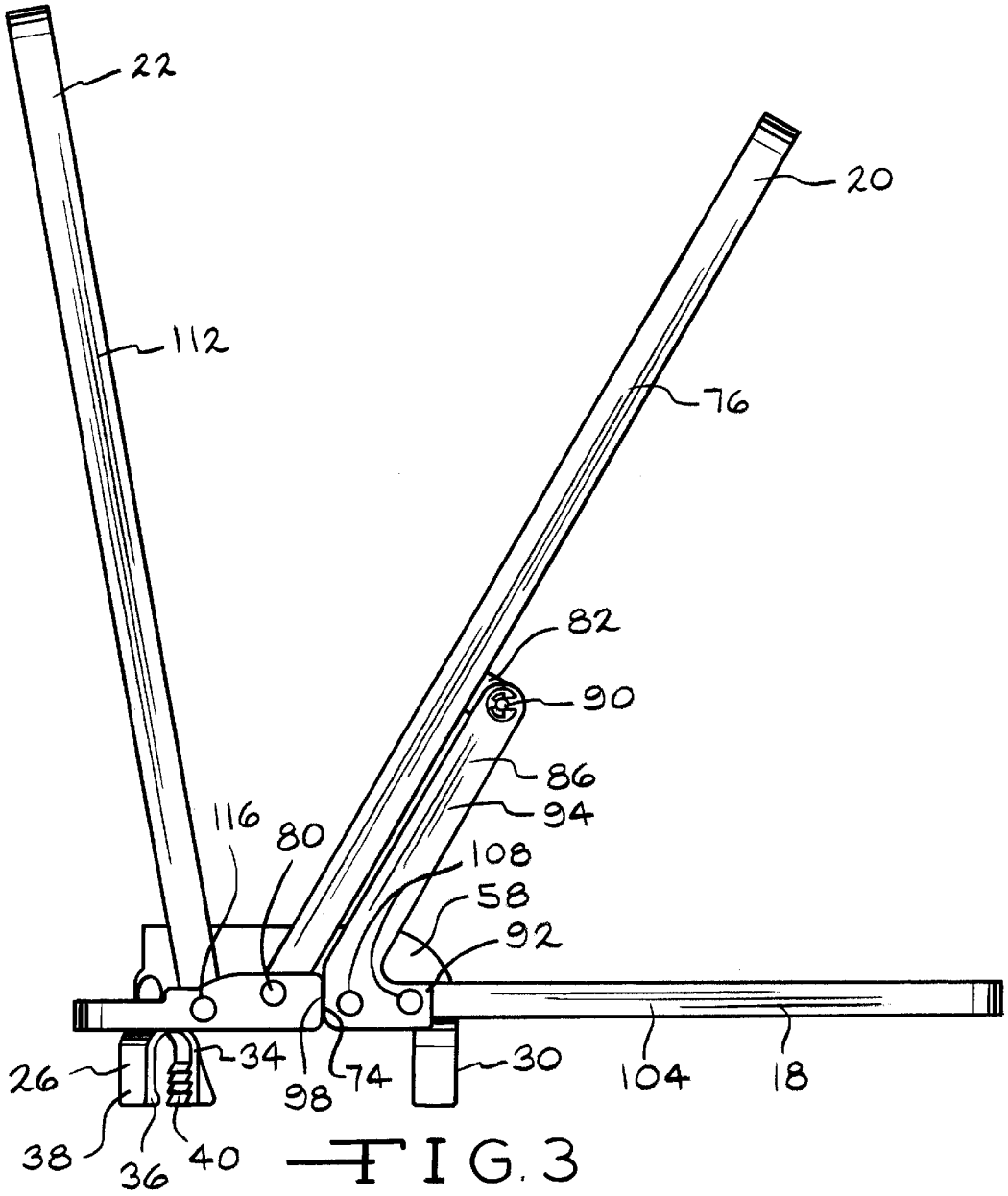
FIG. 3 is a side elevational view of the rib structure of the present golf bag cover device in a closed position.

The legs 76 and 78 of the second rib 20 are each provided with respective ears 82 and 84. The ears 82 and 84 in turn support the respective distal ends of brackets 86 and 88 of the first rib 18 pivotably connected to the ears by pins 90. For sake of clarity, only one bracket 86 will be described with respect to FIGS. 3 to 5, it being understood that the other bracket 88 is identical in structure. The bracket 86 comprises a horizontal portion 92 and a leg 94 joined to the horizontal portion 92 at an acute angle and extending to the distal end of the leg 94 connected to the ear 82 by the pivot pin 90. The bracket 86 includes an abutment surface 98 where the leg 94 joins to the horizontal portion 92. As shown in FIG. 3, with the cover device 10 in the closed position, the abutment surface 98 rests against the end wall 74, opposite where leg 76 of the second rib 20 contacts the end wall 74.

Figure 4:
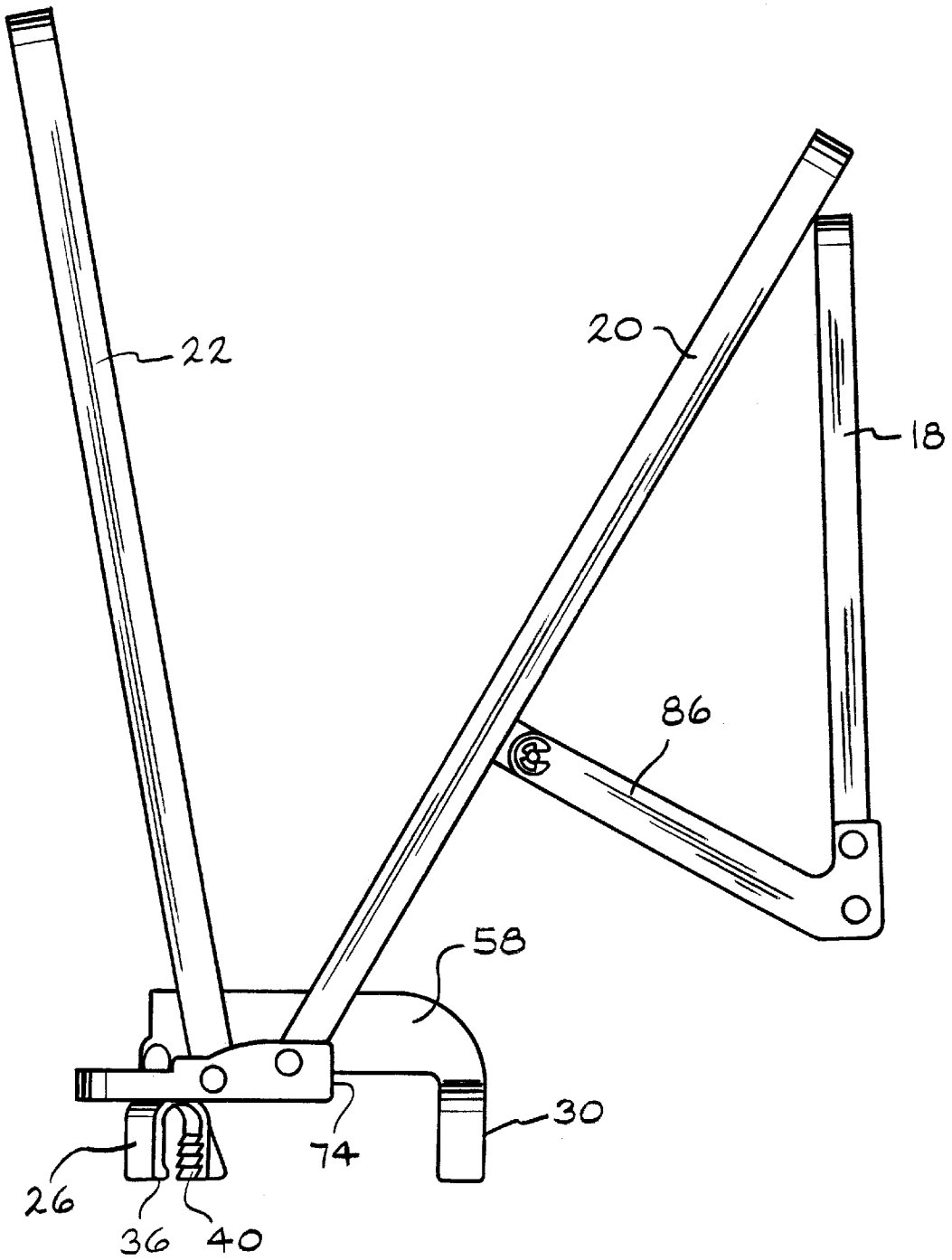
FIG. 4 is a side elevational view of the rib structure shown in FIG. 3 with the first rib rotated up into contact with the second rib.
Figure 5:
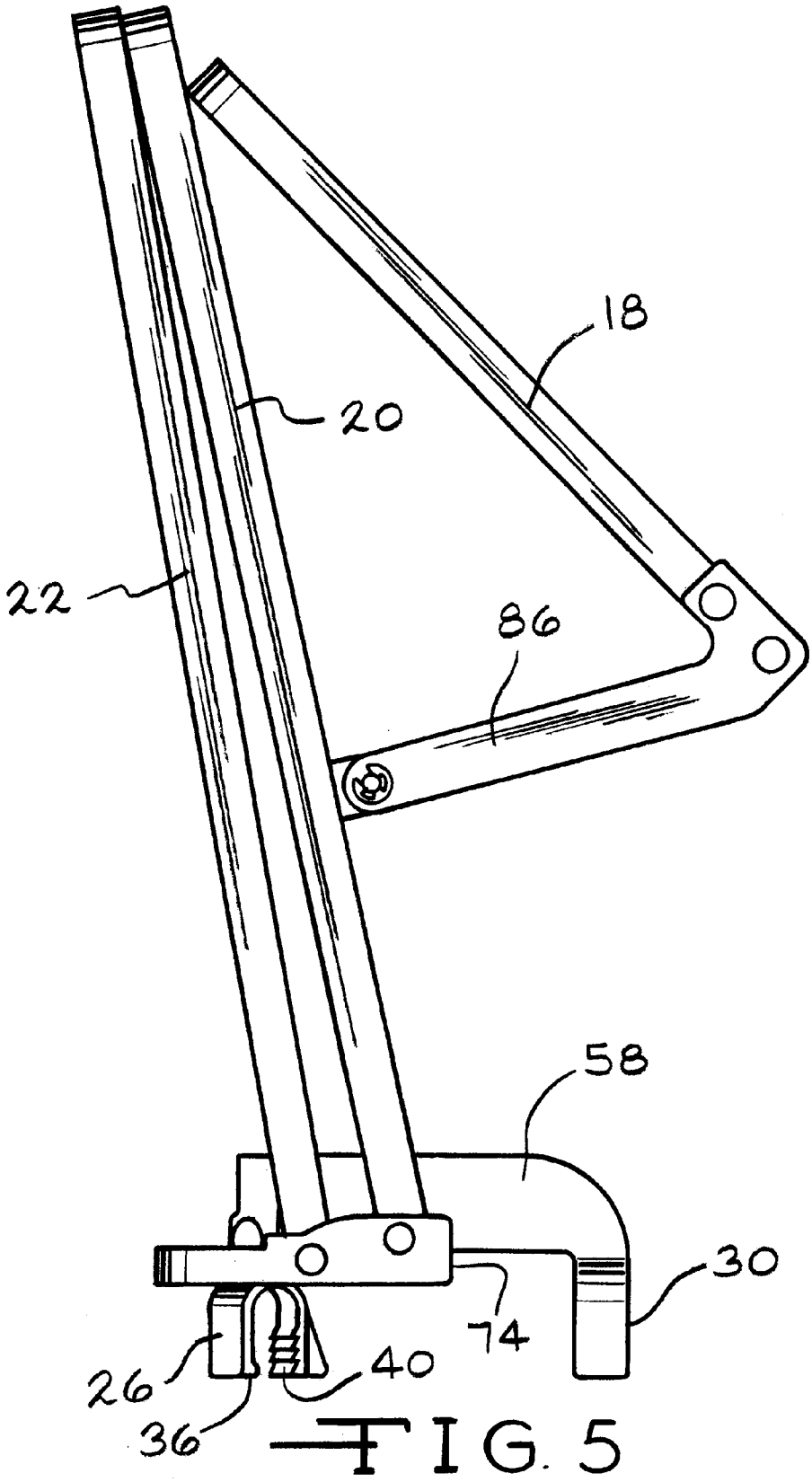
FIG. 5 is a side elevational view of the rib structure shown in FIG. 4 having the first and second ribs rotated up into contact with the third rib.

The first rib 18 further includes a U-shaped member 100 having an intermediate section 102 extending to and meeting with opposed legs 104 and 106. As shown in FIGS. 3 to 5, the horizontal portion 92 of the bracket 18 support the leg 104 of the first rib 18 secured thereto by a pair of fasteners 108, such as rivets and the like. In the forward or closed position shown in FIGS. 2 and 3, the first rib 18 is disposed in a generally horizontal orientation with the intermediate section 102 spaced from the rim 12 (FIG. 2) surrounding the opening leading into the bag 14.

As shown in FIGS. 1 and 2, the third rib 22 is a U-shaped member having an intermediate section 110 extending to and meeting with opposed legs 112 and 114. Each of the legs 112 and 114 is fixedly secured to the base 16 by a fastener 116. As shown in FIGS. 3 to 5, the third rib 22 is disposed in an orientation slightly tilted away from the vertical and away from the first and second ribs 18 and 20.

In Use

In use, the golf bag cover device 10 is mounted on the rim 12 of the golf bag 14 by the pair of forward clips 26 and 28 and the pair of rearward clips 30 and 32. In the fully covered position shown in FIGS. 1 to 3, the legs 104 and 106 of the first rib 18 have a length sufficient to position the intermediate section 102 beyond the perimeter of the rim 12 of the golf bag 14. The distance between the intermediate section 102 of the first rib 18 and the rim 12 is sufficient to enable a golfer to reach under the intermediate section 102 and up toward the rim 12 while only touching the intermediate section 102 with the back of his hand H.

As the golfer continues to move his hand H toward the golf bag 14 to grab a club (not shown), the first rib 18 moves in an upwardly direction with the brackets 86 and 88 pivoting about the pins 90 connected to the ears 82 and 84 of the second rib 20. This range of movement is sufficient to enable the intermediate section 102 of the first rib 18 to contact the second rib 20 (FIG. 4).

As shown in FIG. 5, the second rib 20 is simultaneously pivotable about the pins 80 toward the third rib 22 to allow complete and unhindered access to the golf clubs carried by the golf bag 14. That way, access is provided without the golfer having to touch the palm of his hand H to any portion of the golf bag cover device 10. This precludes any chance of the golfer's palm getting wet if the golfer is playing during rainy weather and the like.

Once the golfer has selected a club and removed it from the golf bag, the weight of the first rib 18 causes that rib to rotate in a downwardly direction about the pivot pins 90 toward the golf bag 14. This movement pulls the second rib 20 away from the third rib 22 until the legs 76 and 78 of the second rib 20 rest against the end walls 74 of the legs 70 and 72 of the base 16, and the abutment surface 98 of the bracket 86 abuts the end walls 74 opposite the second rib 20.

It is appreciated that various modifications to the inventive concepts described herein may be apparent to those skilled in the art without departing from the spirit and scope of the present invention as defined by the hereinafter appended claims.

What is claimed is:

1. A cover device mountable to a rim surrounding an open end of a golf bag, the cover device comprising:

a) a base for mounting the cover device to the rim of the golf bag and about the open end thereof;

b) a first rib;

c) a second rib, wherein the first rib is pivotably connected to the second rib which in turn is pivotably connected to the base;

d) a third rib extending from the base and away from the golf bag, wherein the first rib has a portion extending beyond a perimeter of the rim of the golf bag and in a plane generally parallel to a plane of the open end with the first rib in a rest position; and e) a cover extending from the base proximate the third rib, and over the first, second and third ribs, wherein the first rib is pivotable into an access position to contact the second rib, and wherein when the second rib is pivotably contacted by the first rib, the second and first ribs are pivotable to contact the third rib to provide access to the golf bag through the open end thereof.

2. The cover device of claim 1 wherein the second rib is a U-shaped member comprising an intermediate portion extending to spaced apart first and second legs pivotably connected to the base and wherein the spaced apart first and second legs each support an ear supporting a pivotably connected third and fourth leg of the first rib to provide for adjustable movement of the first rib with respect to the second rib.

3. The cover device of claim 2 wherein the first rib includes a U-shaped member comprising an intermediate portion extending to the spaced apart third and fourth legs pivotably connected to a respective ear movable along a race of the first and second legs of the second rib.

4. The cover device of claim 3 wherein the spaced apart third and fourth legs of the first rib are each connected to one end of a bracket, and wherein the bracket is pivotably connected to a respective ear supported by the first and second legs of the second rib.

5. The cover device of claim 1 wherein the cover is a plastic or a cloth material.

6. A cover device mountable to a rim surrounding an open end of a golf bag, the cover device comprising:

a) a base for mounting the cover device to the golf bag about the open end thereof;

b) a rib pivotably connected to the base, wherein the rib has spaced apart proximal portions extending to and meeting with the base and a distal portion extending from and intermediate the spaced apart proximal portions, the distal portion of the rib extending beyond a perimeter of the rim of the golf bag, wherein the base restricts movement of the rib to an area aligned along a projection of the open end of the golf bag parallel to a longitudinal axis of the golf bag and only to a rest plane generally parallel to a plane of the open end of the golf bag with the rib in a rest position; and c) a cover extending from the base to the rib, wherein the rib is pivotable from the rest position and into an access position to provide access to the golf bag through the open end thereof.

7. A method for providing access to golf clubs contained in a golf bag during inclement weather, comprising the steps of:

a) providing a cover device comprising: a base for mounting the cover device to a rim of the golf bag and about an open end thereof; a first rib; a second rib, wherein the first rib is pivotably connected to the second rib which in turn is pivotably connected to the base; a third rib extending from the base; and a cover extending from the base proximate the third rib, over the first rib, the second rib and the third rib;

b) mounting the cover device to a rim surrounding an open end of the golf bag with the first rib having an extension portion extending beyond a perimeter of the rim of the golf bag and in a plane generally parallel to a plane of the rim of the golf bag with the first rib in a rest, closed position; and c) reaching under the extension portion and upward toward the open end of the golf bag thereby causing the first rib to pivot into an access position to contact the second rib with the second rib pivoting into contact with the third rib to provide access to the golf bag through the open end thereof.

* * * * *